United States Patent [19]

Tsukuda

[11] 4,371,150

[45] Feb. 1, 1983

[54] SINTERING PLANT

[75] Inventor: Toshio Tsukuda, Niihama, Japan

[73] Assignee: Sumitomo Heavy Industries, Inc., Tokyo, Japan

[21] Appl. No.: 202,717

[22] Filed: Oct. 31, 1980

[30] Foreign Application Priority Data

Nov. 2, 1979 [JP] Japan ..... 54-141192

[51] Int. Cl.[3] ..... F27B 9/12

[52] U.S. Cl. ..... 266/155; 34/164; 75/5; 266/178; 266/195; 266/156; 423/242; 432/90; 432/91

[58] Field of Search ..... 266/155, 156, 176–180, 266/195, 144; 75/5; 34/164; 423/242 R; 432/90, 91

[56] References Cited

U.S. PATENT DOCUMENTS

| | | | |
|---|---|---|---|
| 2,522,576 | 9/1950 | Ingraham | 266/155 |
| 3,460,518 | 8/1969 | Kemmetmueller | 266/155 |
| 3,704,525 | 12/1972 | Devel | 34/164 |
| 3,733,781 | 5/1973 | Bellisio et al. | 423/242 R |
| 4,052,148 | 10/1977 | Pennell et al. | 432/90 |

FOREIGN PATENT DOCUMENTS 54-20904 2/1979 Japan .

*Primary Examiner*—Michael L. Lewis

*Attorney, Agent, or Firm*—Armstrong, Nikaido, Marmelstein & Kubovcik

[57] ABSTRACT

A sintering plant of the type sintering raw materials, such as pulverized ores, while transporting them with a conveyor, in which quicklime is fed to the lower layer of the raw materials on the conveyor so that $SO_x$ produced during sintering process may be mainly contained in gases discharged to the downstream half of wind box array disposed below the conveyor and the gases only from the downstream half are fed through a heat exchanger to a desulfurization equipment having a relatively low capacity. The heat exchanger is arranged to heat water to be fed to a device, such as waste heat boiler, adapted to be operated with thermal energy recovered from a cooler for cooling the finished sinter discharged from the conveyor, whereby the thermal efficiency of the plant can be much improved.

3 Claims, 2 Drawing Figures

SINTERING PLANT

BACKGROUND OF THE INVENTION

The present invention relates to a sintering plant of the type sintering pulverized ores while they are continuously fed at one end of an endless conveyor and transported to the other end thereof.

In order to reduce the steel production costs, there have been long used as the raw materials the sintered concentrates obtained by sintering pulverized iron ores which are inexpensive. However, dust and $SO_x$ are contained in large quantities in the gases discharged from the sintering plants so that the various pollution control standards are enforced so that air cleaning equipments such as dust collectors, desulfurization equipment and so on must be installed in the sintering plants, thereby to prevent contamination of the atmosphere. Installation costs of such pollution control equipments are exceedingly expensive and in general three times as high as the capital costs of the sintering plant proper. In addition, the operation costs of these pollution control equipments are also expensive. As a result, the steel production costs cannot be reduced and remain high.

In order to overcome the above and other problems encountered in the sintering plants, there have been made various proposals such as improvements of individual equipments such as dust collectors, desulfurization equipment, etc., but none has yet been particularly successful.

Meanwhile, there has been proposed a method in which only part of the discharged gases containing especially $SO_x$ in large quantities are fed into the desulfurization equipment in order to make it small in size, thereby reducing the capital, operation and other costs. According to the proposed method, an array of wind boxes is disposed below the conveyor for supplying air over the pulverized iron ores being transported and sucking the gases generated when the iron-ores are sintered. In this case, the gases with high $SO_x$ concentrations are discharged from the intermediate wind boxes between the feed and discharge ends. Therefore there has been proposed a method for feeding only the gases discharged from the intermediate wind boxes into a desulfurization equipment. However, in practice, the temperatures of the discharged gases are relatively low so that $SO_x$ become mists in the succeeding stage such as a dust collector disposed immediately upstream of the desulfurization equipment. Therefore it follows that some means must be provided so as to prevent the temperature drop of the discharged gases. In addition, it is difficult to select the wind boxes from which the gases with higher $SO_x$ concentrations are discharged. If the number of the selected wind boxes is large, the capacity of the desulfurization equipment must be increased accordingly. On the other hand, when the number of selected wind boxes is too small, the gases which are discharged without being desulfurized would contain $SO_x$ in certain quantities.

In order to overcome these problems, as disclosed in Japanese Patent Laid Open No. 20904/79, the inventor has proposed a method in which quicklime and water are added to the lower layer of raw materials being transported by the conveyor so that $SO_x$ are generated only in the last half of the sintering process and gases discharged only through the downstream half of a wind box array are fed into the desulfurization equipment.

This method has succeeded in eliminating almost all $SO_x$ discharged from the sintering machine with the desulfurization equipment with a relatively low capacity. However, this method has a problem that since the temperatures of the gases discharged from the downstream half of the wind box array are higher than an allowable temperature of the desulfurization equipment, they must be cooled before they are fed into the equipment. More specifically, with a desulfurization equipment of stack gas by active carbon with moving layer method, active carbon particles would be burned if high temperature gases are fed. Thus, the temperatures of the gases fed into the desulfurization equipment must be less than 220° C. at the maximum. With the desulfurization equipment of the wet type using lime and gypsum, satisfactory results cannot be attained unless the gases to be fed are cooled below 60° C. In addition, because of the complicated drain treatments, the desulfurization equipment of the wet type described cannot be used in combination with the sintering plant of the type described.

Obviously, the iron manufacturing plants consume the thermal energy in large quantities so that the improvement of thermal efficiency is essential for increasing the productivity. Therefore it follows that the above-described method in which the discharged gases are cooled before they are fed into the desulfurization equipment results in nothing but waste of still valuable thermal energy. As a result, the thermal efficiency drops and this demerit cancels the merit obtained by making the desulfurization equipment compact in size.

SUMMARY OF THE INVENTION

In view of the above, the primary object of the present invention is to provide a sintering plant in which the thermal energy still available after cooling the discharged gases to be fed into the desulfurization equipment can be further recovered so that the overall thermal efficiency of the sintering plant can be remarkably improved.

Another object of the present invention is to provide a system with which a machine for utilizing the recovered thermal energy can be operated in a stabilized manner.

To the above and other ends, briefly stated, the present invention provides a sintering plant of the type including a sintering machine with a transport means for continuously transporting raw materials and a means for igniting said raw materials being transported, whereby said raw materials are sintered while they are transported to the discharge end of said sintering machine; a means for feeding quicklime to the lower layer of said raw materials fed on said transport means; an array of wind boxes disposed below said transport means for sucking gases generated when said raw materials are being sintered; a desulfurization means; a first duct for flowing the gases discharged through an upstream half of said wind box array; a second duct for flowing the gases discharged through a downstream half of said wind box array into said desulfurization means; a cooler for cooling the finished sinter discharged from said sintering machine; and a thermal energy recovery means adapted to heat water with the waste heat from said cooler, in which there is provided a heat exchanger for effecting the heat transfer between said gases flowing through said second duct and the water supplied to said thermal energy recovery means.

The above and other objects, effects and features of the present invention will become more apparent from the following description of one preferred embodiment thereof taken in conjunction with the accompanying drawings.

DESCRIPTION OF THE PREFERRED EMBODIMENT

Figure 1:
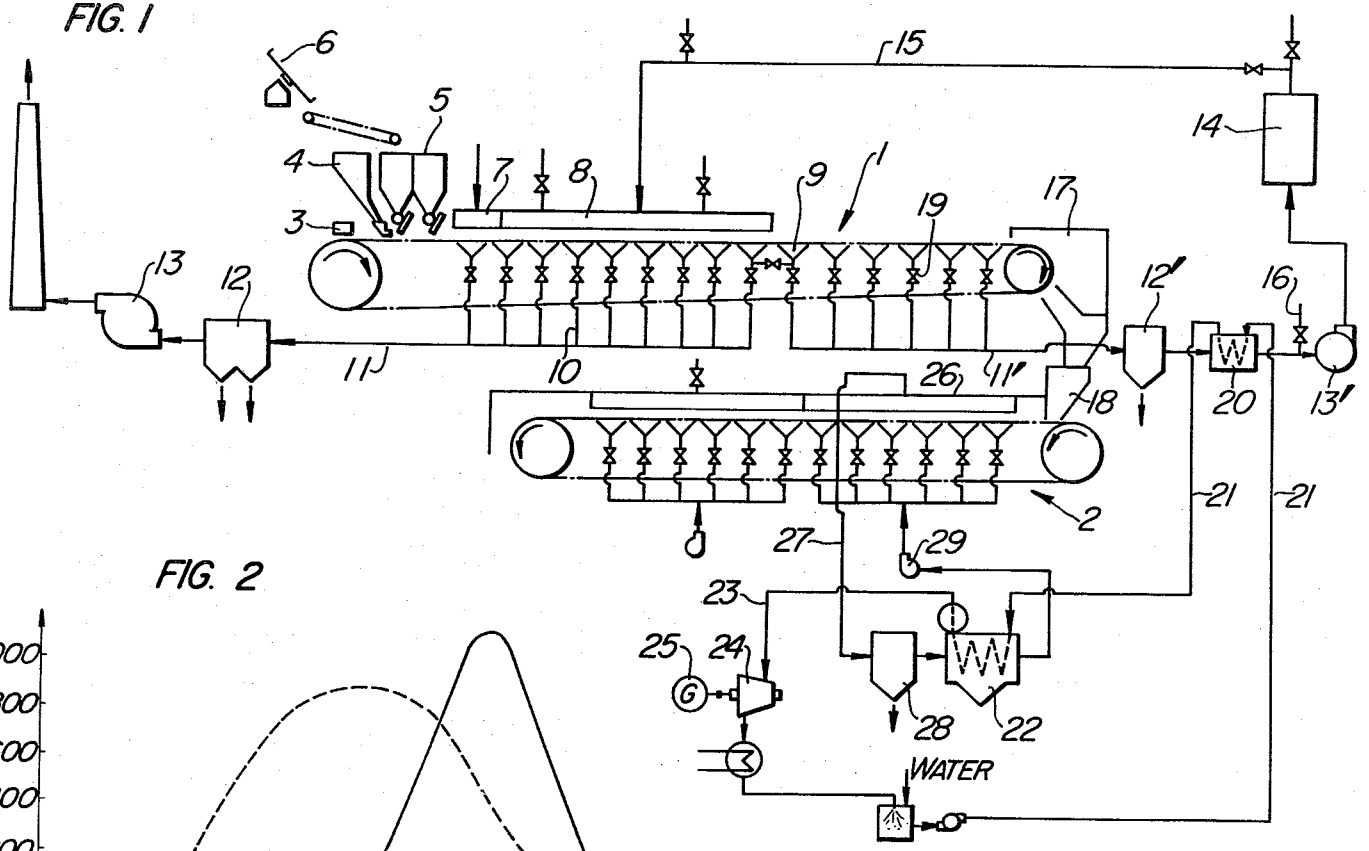
FIG. 1 is a schematic diagrammic view of a preferred embodiment of a sintering plant in accordance with the present invention.

Referring to FIG. 1, a preferred embodiment of a sintering plant in accordance with the present invention will be described. Reference numeral 1 designates a sintering machine; 2, a cooler; 3, a pallet mounted on an endless grate conveyor of the sintering machine 1 so as to travel endlessly therethrough; 4, a floor material hopper; 5, a surge hopper which is divided into two compartments each with a spout so that lower and upper layers of raw materials may be formed in the pallet 3 charged with the floor material; and 6, a lime charging equipment for feeding quicklime to the lower layer material feeding compartment of the surge hopper 5 so that the water and quicklime are added to and mixed with the raw materials in the lower layer and thus those materials are coated with quicklime. The raw materials consisting of pulverized ore and coke (in some cases further added with the recovered iron ore and lime for obtaining self-/fluxing sinter). Alternatively the quicklime may be added to the floor material. In this case the division of the surge hopper 5 is not needed. The reference numeral 7 denotes an ignition hood; 8, a circulation gas hood disposed in opposed relationship with the tops of the pallets 3 travelling with the conveyor and in upstream half of an array of wind boxes 9 which is divided into an upstream and a downstream groups and disposed in opposed relationship with the bottom of the pallets 3; 10, suction pipes which are also divided into the upstream or feedside group and the downstream or discharge-side group at a ratio of about 3:2; 11 and 11', ducts communicated with the upstream or feed-side group of discharge-suction pipes 10 and the downstream or discharge-side group of discharge-suction pipes 10, respectively, the duct 11 being communicated through a dust collector 12 and blower 13 with a stack while the duct 11' being communicated through a dust collector 12' and a blower 13' and a heat exchanger 20 with a desulfurization equipment 14; 15, a circulation gas line communicating the desulfurization equipment 14 with the circulation gas hood 8; 16, a free air line for feeding the air into the downstream or discharge-side duct 11' for the purposes of not only adjusting the properties of the gas to be recirculated to the hood 8 but also replenishing the sintering air; 17, a discharge hopper; 18, a feed hopper to the cooler 2; 19, a damper inserted into each discharge-suction pipe 10; 21, a water line which passes through the heat exchanger 20 and communicated with a waste-heat boiler 22; 23, a steam line communicated with the water line 21 and extended through the boiler 22 to a turbine 24; 25, a generator driven by the turbine 24; 26, a hood covering the cooler 2 and divided into the high temperature section and the low temperature section; 27, a circulation duct for establishing the circulation passage between the boiler 22 and the high temperature section of the cooler hood 26; and 28 and 29, a dust collector and a blower, respectively, inserted into the circulation duct 27.

Next the mode of operation of the sintering plant with the above-described construction will be described. As the pallet 3 travels, the upper layer of raw materials is ignited and sintered so that gases containing $SO_x$ are generated. When these gases pass through the lower layer of raw materials, $SO_x$ is absorbed by $Ca(OH)_2$ which is the product of the reaction between quicklime (CaO) and water ($H_2O$) added to the lower layer. $Ca(OH)_2$ reacts with absorbed $SO_x$ and changes to $CaSO_3$, but when the sintering proceeds toward the lower layer, $CaSO_3$ is thermally decomposed into CaO and $SO_x$.

As described above, $SO_x$ which is generated when the upper layer is sintered is once absorbed by $Ca(OH)_2$ produced from quicklime added into the lower layer and is liberated again when the lower layer is sintered. As a result, $SO_x$ is mainly concentrated into the gases exhausted from the downstream or discharge-side wind boxes 9.

The above-described chemical reactions may be summarized as follows:

$$CaO + H_2O \rightarrow Ca(OH)_2$$

$$Ca(OH)_2 + SO_2 \rightarrow CaSO_3 + H_2O$$

$$CaSO_3 \xrightarrow{heat} CaO \text{ and } SO_2$$

According to the present invention, as will be described later in more detail, the gases discharged from the downstream or discharge-side wind box 9 may be returned to the circulation gas hood 8 through the return gas line 15 so that the exhaust gases can be used as the air for sintering in the upstream or feed-side section. The circulated or return gases have high temperatures, but the partial pressure of the oxygen is relatively low (about 17–19%) so that the sintering reaction in the upstream or feed-side section is relatively retarded but the preheating effect is enhanced.

Figure 2:
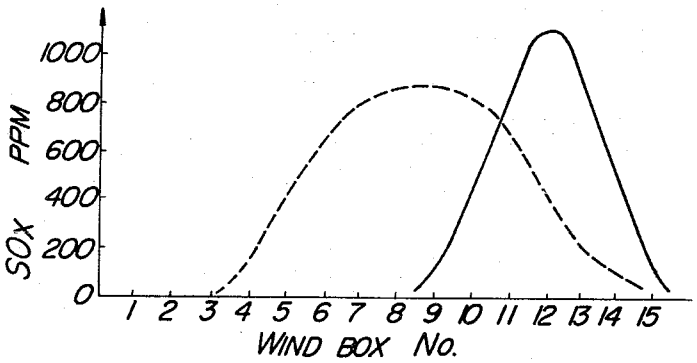
FIG. 2 is a graph showing the $SO_x$ concentrations in the gases discharged through individual wind boxes.

FIG. 2 which is the graph showing the concentration in ppm of $SO_x$ discharged from each of fifteen wind boxes in a sintering machine. The broken-line curve shows the concentrations obtained in the prior art sintering plant in which the raw materials are sintered without being added with quicklime and without use of the circulated gases. It is seen that the curve rises gradually from No. 4 wind box, gradually flattened between No. 6 and No. 11 wind boxes and then gradually drops toward No. 14 wind box. Thus the curve is roughly in the form of a trapezoid. The solid line curve shows the concentrations obtained in the sintering plant in accordance with the present invention in which quicklime is added to the lower layer of raw materials and the exhaust gases are circulated so as to be used as the sintering air in the upstream or feed-side section as described elsewhere. It is seen that the concentrations of $SO_x$ are very high in the exhaust gases discharged from Nos. 10 through 14 wind boxes.

Referring back to FIG. 1, the exhaust gases discharged from the upstream or feed-size section consisting of Nos. 1 through 9 wind boxes are discharged through the feed-side duct 11 and the dust collector 12, but the gases discharged from the downstream or dischargeside section consisting of Nos. 10–15 wind boxes are introduced through the discharge-side duct 11', the dust collector 12' and the heat exchanger 20 into the desulfurization equipment 14 so as to remove $SO_x$. The exhaust gases free from $SO_x$ are discharged into the surrounding atmosphere or circulated through the circulation gas line 15 into the circulation gas hood 8 and used as the sintering air as described elsewhere. The temperatures of the gases discharged from the downstream-side wind boxes are about 300° C. and the gases are made to flow through the heat exchanger 20 so that the gases at about 200° C. may be charged into the desulfurization equipment 14.

The present invention is featured in that the gases discharged from the sintering machine as just described above are cooled in the heat exchanger 20 before they are fed into the desulfurization equipment 14. The discharged gases flow through the duct 11' into the heat exchanger 20' and transfer their heat to the water. The heated water flows through the line 21 into the boiler 22 to which is fed the gases of about 410° C. discharged from the high-temperature section in the cooler 2. As a result, the hot water from the heat exchanger 20 becomes the superheated steam which in turn is fed through the steam line 23 to the turbine 24 which in turn drives the generator 25, whereby the thermal energy of the discharged gases is converted into the electrical energy.

In general, the temperatures of the gases discharged from the downstream-side wind boxes 9 of the sintering machine 1 are not constant and vary depending upon the sintering conditions. The temperatures of the gases discharged from the high-temperature section in the cooler 2 are dependent upon the temperatures of the gases discharged from the downstream-side wind boxes of the sintering machine 1 in such a way that the higher the temperatures of the gases discharged from the downstream-side wind boxes 9, the lower the temperatures of the gases discharged from the high-temperature section in the cooler 2, and vice versa. It follows therefore that the lesser the quantity of the thermal energy recovered by the heat exchanger 20, the larger the quantity of the thermal energy recovered by the boiler 22, and vice versa. As a result, the total thermal energy recovered by both the heat exchanger 20 and the boiler 22 is constant regardless of the variation in temperature of the gases discharged from the discharge-side section of the wind box array 9 of the sintering machine 1. Thus the operation of the turbine 24 can be stabilized.

In summary, according to the present invention, in the sintering plant in which quicklime is added to the lower layer of raw materials so that $SO_x$ may be generated mainly in the downstream stage in the sintering machine and only the gases discharged through the downstream-side wind boxes are desulfurized and the thermal energy is recovered from the gases discharged from the cooler for cooling the produced sinter, a heat exchanger is disposed upstream of the desulfurization equipment so that the discharged gases transfer their heat to the water which in turn is fed into the equipment for recovering the thermal energy from the gases discharged from the cooler. As a result, the effective operation of the desulfurization equipment can be ensured and furthermore the thermal energy can be recovered from the sintering plant at a higher ratio.

What is claimed is:

1. A sintering plant in combination with an energy recovery system wherein the sintering plant comprises:

a sintering machine having transport means for continuously transporting raw materials, and means for igniting the raw materials being transported, whereby the raw materials are sintered while being transported to a discharge end of the machine.

means for feeding quicklime to a lower layer of the raw materials fed on the transport means;

an array of wind boxes disposed below the transport means for sucking gases generated when the raw materials are sintered;

desulfurization means;

a first duct connected to an upstream half of the wind box array for discharging gases therefrom;

a second duct connected between a downstream half of the wind box array and the desulfurization means; and means for removing heat from the finished sinter discharged from the sintering machine including a high temperature section and a low temperature section downstream thereof; and the energy recovery system comprises;

a steam-producing boiler operatively associated with said means for removing heat, said boiler receiving heat therefrom;

heat exchanger means disposed in said second duct and connected to said boiler for preheating water fed to said boiler;

means for circulating cooling gases from said high temperature section to said boiler and back to said high temperature section;

means for utilizing steam produced in said boiler;

conduit means interconnecting a source of water, said heat exchanger means, said boiler and said utilizing means; and means for circulating water in said conduit means.

2. The combination as set forth in claim 1 wherein the sintering plant further comprises a circulated-gas hood disposed above the upstream half of said transport means and connected to said desulfurization means so that the gases discharged from said desulfurization means can be fed into said hood.

3. The combination as set forth in any one of claims 2 or 1 in which:

said means for utilizing steam comprises:

a steam turbine driven with superheated steam generated in said boiler.

* * * * *